US005651627A

United States Patent [19]

Dowzall et al.

[11] Patent Number: 5,651,627

[45] Date of Patent: Jul. 29, 1997

[54] NIB CONVERSION UNIT

[75] Inventors: Martin Edward Dowzall, Franklin Lakes; David Wellings Pointon, Riverdale; Vazgen John Houssian, Union City, all of N.J.

[73] Assignee: Esselte Corporation, Garden City, N.Y.

[21] Appl. No.: 612,266

[22] Filed: Mar. 7, 1996

[30] Foreign Application Priority Data

Sep. 10, 1993 [GB] United Kingdom ..... 9318844

[51] Int. Cl.[6] ..... B43K 8/02; B43K 8/04; B43K 8/08

[52] U.S. Cl. ..... 401/199; 401/18; 401/36

[58] Field of Search ..... 401/199, 36, 18

[56] References Cited

U.S. PATENT DOCUMENTS

| | | | |
|---|---|---|---|
| 4,364,684 | 12/1982 | Kohno et al. | 401/199 X |
| 4,610,556 | 9/1986 | Tsai . | |
| 4,960,340 | 10/1990 | Tamiya et al. . | |

FOREIGN PATENT DOCUMENTS

| | | | |
|---|---|---|---|
| 1250302 | 9/1967 | Germany | 401/199 |
| 24 59 860 | 6/1976 | Germany . | |
| 1005487 | 9/1965 | United Kingdom . | |
| 1237043 | 6/1971 | United Kingdom . | |
| WO93/17879 | 9/1993 | WIPO . | |

*Primary Examiner*—Steven A. Bratlie
*Attorney, Agent, or Firm*—Darby & Darby

[57] ABSTRACT

A holder for an auxiliary nib is disclosed which is intended to be fitted on the body of a main marker pen when a finer line is to be drawn. The auxiliary nib holder has as its outer end a cavity in which fits a length of ink-permeable material in ink-transfer contact or relationship with a projecting fine nib. Also seated with the cavity is an axially-movable preferably globular wick which is prevented from falling out of the inner end of the cavity, e.g. by means of an end rib. The globular wick is of controlled and known permeability, so that ink is able to flow at a known and acceptable rate to the fine nib when the auxiliary nib holder is in position in the marker pen and the globular wick is engaged by the marker nib.

12 Claims, 1 Drawing Sheet

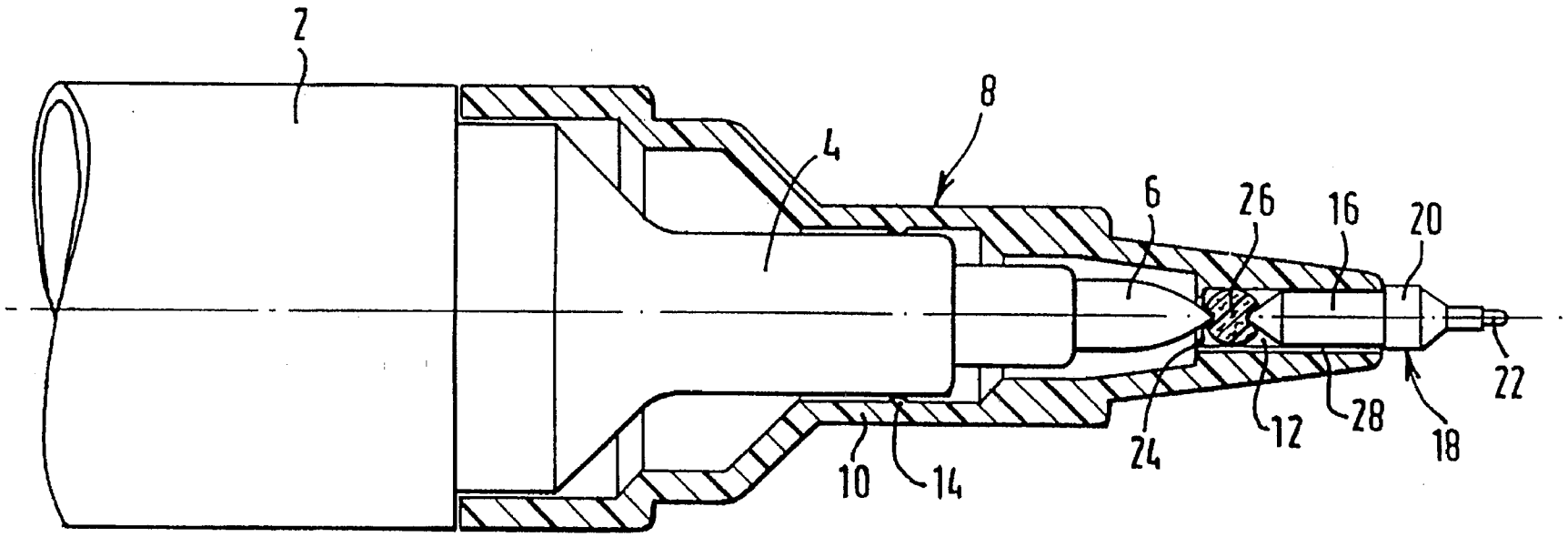
22
18
20
28
16
12
26
24
6
8
14
10
4
2

NIB CONVERSION UNIT

This is a continuation of international application Ser. No. PCT/GB94/01867, filed Aug. 26, 1994.

This invention relates to nib units, especially for felt and fibre tip marker pens, although the invention is also applicable to technical pens.

Felt and fibre tip marker pens have found widespread acceptance in a variety of fields of use. They are available commercially in a substantial number of shapes and sizes depending upon the intended use. Common to all of them, however, is some form of ink reservoir adapted to enable ink to flow to a tip or nib formed of felted or laid fibrous material, the latter particularly in the case of smaller-size nibs. The nib is protected against drying out, and inadvertent contact with other surfaces when the pen is not in use, by means of an end cap. The reservoir may be provided with a small passage to atmosphere, to keep the ink in the reservoir under atmospheric pressure irrespective of changes in the ink volume with use.

The size of the nib is an important consideration for felt and fibre tip pens, as it determines the width of a line drawn with the pen. The stroke width is usually chosen in accordance with the intended use of the pen, with wide nibs being used for writing large inscriptions, such as on the outsides of parcels, or for colouring large areas of artwork, and with narrow nibs being used for fine artistic graphic work or for normal fine handwriting.

The particular selection of a marker pen may depend on a variety of considerations. In the professional use of such markers for creating artwork, however, a major consideration is the availability of the marker in a desired colour. There are several commercially-available ranges of marker pens offering a wide variety of ink colours. Some of these marker pens are available as so-called "double-ended" markers, with a relatively-wide nib at one end, and a relatively-narrow nib at the other, each with its respective end cap.

Ranges of such markers, commonly referred to as 'art markers', are bought by graphic and commercial artists in particular, because of their availability in a wide range of colours.

Such artists sometimes find that, in order to secure a specific effect, in particular to be able to draw a very thin line for use in detailed work, even the thinnest available nib is too wide. The nibs of such art markers are often made of a compact body of parallel fibres of nylon, polyester or acrylic resins, which nibs have a relatively-firm texture and can be sharpened, as by using a craft knife, to give a considerably-finer nib.

The problem with making such thin nibs is that while they may give entirely satisfactory results, once they have undergone surgery in this fashion, they cannot be reinstated to their former condition, and must therefore often be discarded, which is wasteful and expensive.

GB-A-1 005 487 discloses a marking instrument having an ink container with a broad nib having a bevelled end, and an auxiliary tip holder engageable on the body of the marking instrument and including a fine nib of which one end contacts the broad nib so as to receive ink. In one version of this known marker, a body of wick material is used to convey ink from the main nib to a tubular outlet through which ink flows for marking or writing.

U.S. Pat. No. 4,610,556 describes a multi-tip writing instrument having interchangeable nib units which are intended to be mounted in cascade. The nibs are of different types, such as fountain pen, ball pen and fibre tip. When nested together, fibrous materials are used to ensure that ink flows from one nib unit to the next by means of capillary forces.

The present invention aims at giving users of marker pens able to draw lines of one width the ability to fit such pens with finer auxiliary nibs which have ink supplied to them from the main nib.

Accordingly the present invention provides a holder for an auxiliary nib, the holder comprising a hollow body able to be secured resiliently to the body of a marker from which projects a main nib of ink-permeable material acting as an ink reservoir, the holder having mounted at its end remote from the marker body a length of inner ink-permeable material one end of which forming a fine nib, characterised in that the other end of the inner ink-permeable material and one end of the main nib have a conical or domed end face, the holder has mounted at its end remote from the marker body a fine nib unit comprising an outer elongate feeder body from the ends of which extends the length of inner ink-permeable material, the feeder body being housed within a cavity having captive within it an axially-movable wick adapted to be compressed between the conical or domed end face of the inner ink-permeable material and the conical or domed end face of the main nib when the holder is in place on the marker body to transfer ink from the main nib to the fine nib, the wick being composed of a substantially resilient material softer than at least the conical or domed end face of the inner ink-permeable material and at least the conical or domed end face of the main nib.

The present invention will now be described by way of example with reference to the accompanying drawing, which is a side-elevation, part in section, of a marker pen fitted with an auxiliary nib holder of the present invention.

The marker pen shown in the drawing has a main cylindrical body 2 fitted with a housing 4 of plastics material from the outer end of which projects a nib 6 in the form of a compacted body of fibres having a domed or conical end. Fitting on the housing 4 is a holder 8 for an auxiliary nib, the holder comprising a hollow body 10 of plastics material having a cylindrical cavity 12 at its outer end. The wider end of body 10 is a snug fit on the shoulder formed where housing 4 meets body 2, and an inner annular rib 14 on an intermediate part of body 10 is a tight fit on housing 4, so as to hold body 10 in place on the housing by virtue of the inherent resilience of the material from which body 10 is formed.

Forming a snug fit in cavity 12 is a feeder section 16 of a fine nib unit 18, of which the other parts comprise a wider section 20 of plastics material and a central length of ink-permeable material, one end of which projects a short way to function as a fine nib 22, and the other end of which forms a conical apex at the left hand end of section 16 as seen in the drawing. The central length of ink-permeable material and the feeder sections 16 and 20 may be formed from the same monolithic body of material, or from an outer ink-impermeable tube closely surrounding the ink-permeable material, which may have a width at the end of nib 22 of 0.5 to 0.7 mm which when used draws a line of about 0.4 mm width.

A particularly preferred method of making the unit 18 is to form a central extruded hollow type (of labyrinthine cross-section) and extrude around it an impermeable thick-walled tube, e.g. of outer diameter as section 20. The nib unit 18 may be made by removing the outer thick-walled tube selectively to give the shape shown in the drawing, all the thickness of the outer tube being removed at one point to reveal nib 22. This approach produces an easily handled unit 18 despite the small size and relative weakness of the central extruded hollow tube.

The shoulder provided by where the body 20 meets the feeder section 16 is of greater diameter than that of the cavity 12, so that axial forces on nib 22 are transferred to body 10, so that writing and drawing pressures do not cause the fine nib unit 18 to be driven into the body 10.

At the inner end of cavity 12 is an annular rib 24. Although this is indicated in the drawing as being continuous, it may be replaced by a series of pips spaced apart angularly in the same radial plane. Whether continuous or intermittent, the rib 24 acts to prevent a globular wick 26 from falling out of its place between the inner conical end of feeder section 16 and rib 24. The outer diameter of wick 26 is greater than the inner diameter of rib 24, so that the wick 26 cannot drop out of the cavity 12 under the action of gravitational forces or shaking or other movements imparted to the holder 10 in use.

The ideal shape of the wick 26 is spherical as shown in the drawing, but this is difficult to manufacture. Although wicks of different shapes, e.g. cubic, cylindrical or hemi-spherical would work, a shape that works well and is easier to manufacture than a sphere is that of a short cylinder having a domed face at one end.

The wick 26 may be of any suitable ink-permeable material, such as wool-felt, open-celled foamed plastics materials, such as polyethylene foam, open-celled sponge rubber or needled fibres of suitable plastics material. The permeability of the wick 26 can be chosen to regulate the flow of ink through it, and accordingly to regulate the flow of ink through the fine nib 22. This is of particular value in the case of use of the auxiliary nib holder with double-ended markers having a very wide felted nib at on end, e.g. 5 to 9 mm wide, and a narrower nib, e.g. 2 to 4 mm diameter at the other, as such markers, in order to be usable with high ink flow from the wide nib, need to be filled with very fluid, usually alcohol-based, inks. If these are fed through a fine capillary nib, there is a tendency to flow too fast and this causes "blobbing" at the beginning and end of a stroke. Wick 26 prevents or minimises the risk of blobbing as well as acting to control line width by throttling the flow of very fluid ink to an even, low flow to give an even, first line.

As can be seen from the drawing, when the auxiliary nib holder 8 is in position on a marker pen, the wick 26 is compressed between the normal end of the main nib 6 and the inner conical end of feeder section 16. The degree of compression may be controlled by making it of desired diameter, and by making the fine nib of appropriate length, which length also has an effect on ink flow. We have found that good results are obtained with a diameter of wick 26 of around 1.75 mm and a length of fine nib 22 plus feeder section 16 of 6 to 9 mm, preferably about 8.5 mm.

Since wick 26 is made of ink-permeable material, and in relatively-large area contact with both nib 6 and in contact with the conical end of the ink-permeable centre of feeder section 16, ink is able to flow easily but with a chosen maximum rate of flow from the nib 6 through feeder section 16 to fine nib 22. The wick 26 also acts as a reservoir for ink, albeit of less capacity than nib 6, which aids in providing even ink flow and ink enabling nib 22 to be used continuously without difficulties.

As noted above, the ink-carrying center of the fine nib unit 18 may be made from an extruded plastics material forming a series of parallel and interconnected passages along which ink is transferred by capillary forces. With most cross-sections of the fine nib 22 itself, ink can be transferred along the length of the fine nib at a faster rate than it would normally be used when writing or drawing. In order to prevent the fine nib from forming unintended blobs of ink, an additional function of wick 26 is to restrict the rate at which ink is able to flow through it to the fine nib unit. Depending on the material from which the wick 26 is manufactured, the manufacturing process is itself adjusted or chosen so as to give a desired permeability to the wick. This may be done by the manufacturing process itself, or by a post-manufacturing treatment step. In any case, the wick body 26 is preferably softer than either nib 6 or feeder section 16, so that it is the wick which is deformed by axial force applied to it by the auxiliary nib holder being pushed on to the marking pen preferentially to either nib. Although the wick may be spherical, its dimensions and shape are not critical (though spherical wicks are easier to assemble as they do not need to be oriented) as long as its contact areas with the main and auxiliary nibs are large enough and its ink permeability lies in a chosen range.

When the holder is removed from the main pen, the natural resilience of the material forming the wick body 26 causes the wick to move axially of cavity 12 by virtue of its contact with the inner conical end face of feeder section 16. This axial movement may continue until the wick 26 comes into contact with the rib 24. It does not matter if, by this time, wick 26 has moved out of contact with feeder section 16.

As indicated diagrammatically, preferably the cavity 12 has an associated longitudinal recess 28 formed in it to act as a passage along which air can flow to take up the volume of ink removed from the main marker pen in use. This replacement air passes to the interior of body 2 through conventional air passages in cap 4 which are not shown in the drawing and not described herein in any greater detail, as they are conventional. There might be more than one such passage 28 extending along the length of cavity 12, to ensure that air can always flow into the interior of body 10 irrespective of the state of compression of wick 26, which would tend naturally to fill the normal cross-sectional area of cavity 12 when it is compressed between nib 6 and feeder section 16.

Accordingly it will be seen that the present invention provides means by which ink is conveniently transferred from a main nib to a finer nib by merely mounting the finer nib holder on the body of a main marker.

We claim:

1. A holder for an auxiliary nib that attaches to the end of the body of a marker, the holder comprising:

a hollow body able to be secured resiliently to the body of the marker from which projects a main nib of ink-permeable material acting as an ink reservoir, the main nib having one of a conical and domed face;

a length of inner ink-permeable material having a first end and a second end, the first end, remote from the marker body, being formed into a fine nib, the second end having one of a conical and domed face;

a fine nib unit mounted at the end of the holder that is remote from the marker body, the fine nib unit having an outer elongate feeder body from the ends of which extends the length of inner ink-permeable material, the elongate feeder body being housed within a cavity having captive within it an axially movable wick adapted to be compressed between the second end of the length of inner ink-permeable material and the face of the main nib when the holder is in place on the marker body, thereby transferring ink from the main nib to the fine nib, wherein the axially movable wick is composed of a substantially resilient material which is softer than both the second end of the length of inner ink-permeable material and the face of the main nib.

2. The holder as in claim 1, wherein the holder body has a skirt adapted to be seated on a shoulder of the marker when the holder is fully in position.

3. The holder as in claim 1, wherein the axially-movable wick takes the form of a globular body of ink-permeable material.

4. The holder as described in claim 1, wherein the fine nib unit consists of an inner extruded narrow capillary nib in an outer impermeable casing fitted into the end of the holder body remote from the marker body.

5. The holder as in claim 2, wherein the axially-movable wick takes the form of a globular body of ink-permeable material.

6. The holder as in claim 3, wherein the globular axially-movable wick is of a fibrous material having a known permeability.

7. The holder as described in claim 5, wherein the globular axially-movable wick is of a fibrous material having a known permeability.

8. A marking implement comprising the combination of a marker having a body, and an auxiliary nib holder that attaches to the end of the body of the marker, wherein the auxiliary nib holder comprises:

a hollow body able to be secured resiliently to the body of the marker from which projects a main nib of ink-permeable material acting as an ink reservoir, the main nib having one of a conical and domed face;

a length of inner ink-permeable material having a first end and a second end, the first end, remote from the marker body, being formed into a fine nib, the second end having one of a conical and domed face;

a fine nib unit mounted at the end of the holder that is remote from the marker body, the fine nib unit having an outer elongate feeder body from the ends of which extends the length of inner ink-permeable material, the elongate feeder body being housed within a cavity having captive within it an axially movable wick adapted to be compressed between the second end of the length of inner ink-permeable material and the face of the main nib when the holder is in place on the marker body, thereby transferring ink from the main nib to the fine nib, wherein the axially movable wick is composed of a substantially resilient material which is softer than both the second end of the length of inner ink-permeable material and the face of the main nib.

9. The marking implement as in claim 8, wherein the holder body has a skirt adapted to be seated on a shoulder of the marker when the holder is fully in position.

10. The holder as in claim 8, wherein the axially-movable wick takes the form of a globular body of ink-permeable material.

11. The holder as in claim 10, wherein the globular axially-movable wick is of a fibrous material having a known permeability.

12. The holder as described in claim 8, wherein the fine nib unit consists of an inner extruded narrow capillary nib in an outer impermeable casing fitted into the end of the holder body remote from the marker body.

* * * * *